US007150808B2

(12) United States Patent
Lehmus

(10) Patent No.: US 7,150,808 B2
(45) Date of Patent: Dec. 19, 2006

(54) APPARATUS FOR FORMING A PAPER OR CARDBOARD WEB

(75) Inventor: Ismo Lehmus, Karhula (FI)

(73) Assignee: Vaahto Oy, Hollola (FI)

( * ) Notice: Subject to any disclaimer, the term of this patent is extended or adjusted under 35 U.S.C. 154(b) by 295 days.

(21) Appl. No.: 10/301,683

(22) Filed: Nov. 22, 2002

(65) Prior Publication Data

US 2003/0116297 A1 Jun. 26, 2003

(30) Foreign Application Priority Data

Nov. 23, 2001 (FI) ..... 20012291

(51) Int. Cl.
*D21F 1/00* (2006.01)

(52) U.S. Cl. ..... 162/300; 162/301; 162/351; 162/352

(58) Field of Classification Search ..... 162/300, 162/301, 351, 352
See application file for complete search history.

(56) References Cited

FOREIGN PATENT DOCUMENTS

| | | |
|---|---|---|
| EP | 0397430 | * 11/1990 |
| FI | 83103 | 12/1992 |
| FI | 98540 | 7/1997 |

* cited by examiner

*Primary Examiner*—Mark Halpern
(74) *Attorney, Agent, or Firm*—Birch, Stewart, Kolasch & Birch, LLP

(57) ABSTRACT

An apparatus for forming a paper or cardboard web from a fibrous suspension, said apparatus having a twin wire section consisting of a first wire loop formed by a first wire, a second wire loop formed by a second wire and at least one headbox, from which headbox the fibrous suspension can be fed into the space between the wire loops, said first wire loop being provided with a dewatering box placed above the wire and arranged to drain water from the fibrous suspension between the wire loops via the bottom of the dewatering box and through the first wire, said apparatus having two successive dewatering zones provided in the area of the dewatering box, where the direction of web movement in the area of the first dewatering zone is away from the dewatering box and the runs of each wire loop are substantially straight while in the area of the second dewatering zone the direction of web movement is towards the dewatering box and water drainage from the fibrous suspension is arranged to take place substantially in a direction towards the dewatering box. To achieve more effective water drainage in the second zone, the bottom of the dewatering box forms a fraction line including straight portions and edges between them, over which the web between the two wires moves.

14 Claims, 1 Drawing Sheet

APPARATUS FOR FORMING A PAPER OR CARDBOARD WEB

CROSS REFERENCE TO RELATED APPLICATIONS

The present application claims priority to Finnish Application No. 200112291 filed Nov. 23, 2001.

BACKGROUND OF THE INVENTION

1. Field of the Invention

The present invention relates to an apparatus for forming a paper or cardboard web from a fibrous suspension, said apparatus having a double wire section consisting of a first wire loop formed by a first wire, a second wire loop formed by a second wire and at least one headbox, from where the fibrous suspension can be fed into the space between the wire loops, said first wire loop being provided with a dewatering box placed above the wire and arranged to drain water from the fibrous suspension between the wire loops via the bottom of the dewatering box and through the first wire, said apparatus having two successive dewatering zones provided in the area of the dewatering box, where the direction of web movement in the area of the first dewatering zone is away from the dewatering box and the runs of each wire loop are substantially straight while in the area of the second dewatering zone the direction of web movement is towards the dewatering box and water drainage from the fibrous suspension is arranged to take place in a direction substantially towards the dewatering box.

2. Description of Background Art

Patent specification FI 98540 discloses a hybrid former for forming a paper or cardboard web from a fibrous suspension. In a hybrid former, a web is first formed on a single wire, whereafter the web thus partially formed is passed on to a dewatering zone formed between the two wires for final stabilization of fiber positions relative to each other. According to FIG. 1 of the aforesaid specification, fibrous suspension is supplied from the headbox to the fourdrinier wire part of the second wire loop, where water is drained from the pulpstock by means of dewaterers. The fibrous layer, i.e. the web formed on the second wire loop then moves on to the twin wire section, which consists of the area between the first wire loop and the second wire loop. At the beginning of the twin wire section, the top wire loop and the bottom wire loop form a gap where the top wire loop is brought close to the bottom wire loop at a small angle. Placed inside the wire loop is a dewatering box, which drains water from the web through the first wire by causing it to flow towards the dewatering box.

In the solution according to patent specification FI 98540, the dewatering box is divided into two dewatering zones, i.e. a first straight zone and, next to it, a second curved zone. In the curved zone, the pulp web is caused to assume a curvature determined by the radius of curvature. The compression between the wires is dependent on the radius of curvature and also on the width of the wire.

With the solution in question, a relatively uniform dewatering pressure is achieved. However, the pressure is not always sufficient to drain the water especially in the case of thick sorts of paper and cardboard.

SUMMARY AND OBJECTS OF THE INVENTION

The object of the present invention is to eliminate the drawbacks of prior art solutions and achieve a new type of apparatus in which a pulp web running between two wires moves in the second zone over a suction box surface having a segmented line shaped cross-sectional form, consisting of straight portions and the edges between these. The angles between the straight portions may be of equal or unequal magnitude. The details of the characteristics of the solution of the invention are presented in the claims below.

The solution of the invention provides the advantage of effective dewatering, which is especially due to the pressure pulses produced by wire tension at the edges between the straight portions, said pulses increasing the dewatering efficiency. This is particularly advantageous in the case of thick kinds of paper and cardboard.

BRIEF DESCRIPTION OF THE DRAWINGS

In the following, the invention will be described in detail with reference to the attached drawing, wherein.

DETAILED DESCRIPTION OF THE PREFERRED EMBODIMENTS

Figure 1:
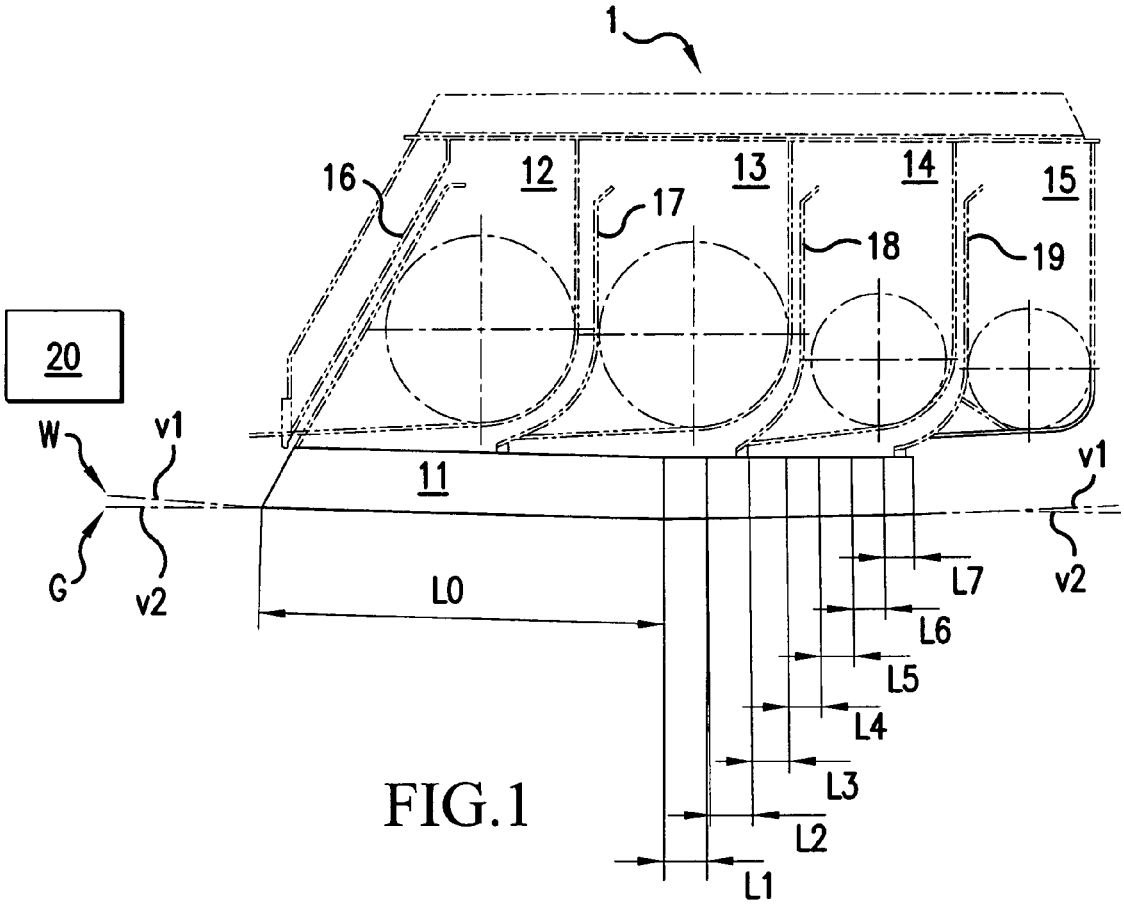
FIG. 1 presents a cross-sectional side view of the wires and suction box of a hybrid former according to the invention.

FIG. 1 presents the suction box 1 in a hybrid former having a twin wire section, which consists of a first upper wire loop formed by a first wire v1 and a second lower wire loop formed by a second wire v2, and a headbox 20, from where a fibrous suspension, or pulp web W is fed into the space G between the wire loops. The fibrous suspension W may be supplied either first onto the fourdrinier wire section formed by the second wire loop or directly into the gap G between the wire loops.

The overhead dewatering box 1 for water drainage is disposed inside the first wire loop. The dewatering box 1 is arranged to drain water from the fibrous suspension W between the wire loops by using the force created by the velocity of the web W together with negative pressure, or by using either one of these expedients alone, through the first wire v1 via the bottom 11 of the dewatering box formed e.g. from strips. Provided in the area of the dewatering box 1 are two successive dewatering zones, L0 and L1–Li, where the direction of motion of the web W in the area of the first dewatering zone L0 is deviated away (as shown by arrow A1) from the dewatering box 1 (at angle μ relative to the horizontal plane) and the runs of both wire loops are straight. In the first dewatering zone L0, the second wire loop may be provided with wire supporting elements (not shown) by means of which a variable pressure acting in the direction of the dewatering box can be applied to the second wire v2.

The suction box 1 used for dewatering may contain several chambers 12–15, into which water is drained from the pulp web W via suction channels 16–19, e.g. by generating a negative pressure in the chambers 12–15, each of which may have a negative pressure equal or unequal to the pressure in the other chambers.

In the area of the second dewatering zone L1–Li, the motion of the web W is directed towards the dewatering box 1 (as shown by arrow A2), and water drainage from the web W takes place substantially in the direction of the dewatering box 1 as in the first zone, being effected e.g. by means of dewatering strips L1–Li provided in the bottom 11.

Figure 2:
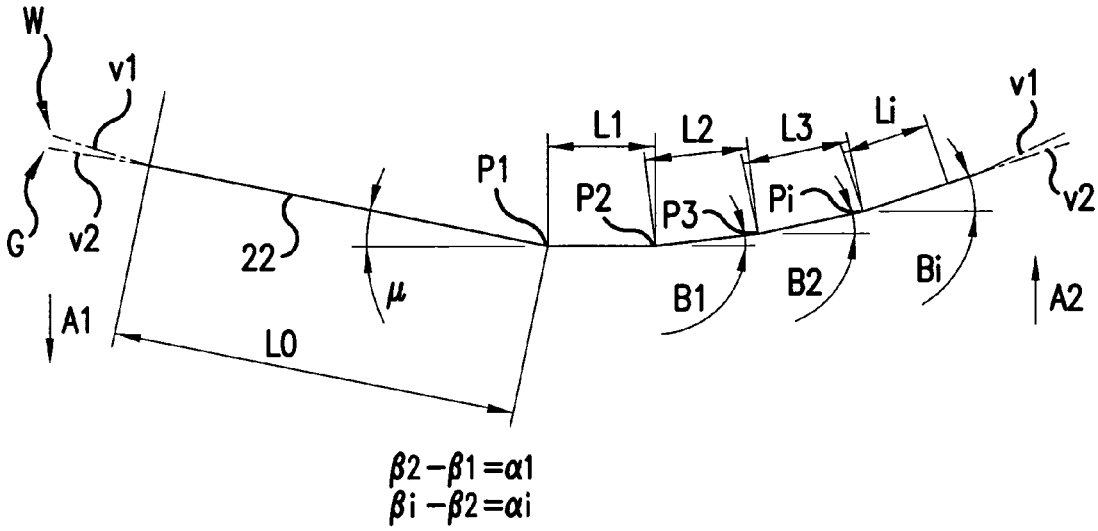
FIG. 2 illustrates the passage of a web running between wires over a suction box surface according to the invention.

In the second zone, the pulp web W between the two wires passes over a segmented line consisting of straight portions L1–Li (e.g. four straight portions as in FIG. 2) and edges or elbows P1–Pi between them, formed in cross-section on the lower surface of the bottom 11 of the suction box. The angles α1–αi between the straight portions (α1 is the difference between the angles β2–β1 of the straight portions L1–Li relative to the horizontal direction, and so on) may be of equal or unequal magnitudes.

At the edges P1–Pi, the tension of the wires v1, v2 produces a pressure pulse that results in effective water drainage. The intensity of the pulse can be adjusted separately for each paper or cardboard sort by using angles of different magnitudes between the straight portions L1–Li of the segmented line surface.

The straight portions L1–Li of the segmented line include one or more replaceable strips of equal or unequal width. The segmented line may also be formed by machining on a solid bottom structure 22.

It is obvious to the person skilled in the art that different embodiments of the invention are not limited to the examples described above, but that they may be varied within the scope of the claims presented below.

The invention claimed is:

1. An apparatus for forming a paper or cardboard web from a fibrous suspension, said apparatus comprising:

a twin wire section consisting of a first wire loop formed by a first wire (v1), a second wire loop formed by a second wire (v2), and at least one headbox, from which headbox the fibrous suspension is fed into a space between the first and the second wire loops, said first wire loop being provided with a dewatering box (1) placed above the first wire and arranged to drain water from the fibrous suspension between the first and the second wire loops via a bottom (11) of the dewatering box and through the first wire, said apparatus further comprising:

two successive dewatering zones (L0, L1–Li) provided in an area of the dewatering box, wherein a direction of web movement in the first dewatering zone is away from the dewatering box, and runs of each first wire loop are substantially straight, while in the second dewatering zone a direction of web movement is towards the dewatering box and water drainage from the fibrous suspension is arranged to take place substantially in a direction towards the dewatering box, wherein the bottom of the dewatering box includes parts formed as strips in a second dewatering zone, and wherein to achieve effective water drainage in the second dewatering zone, the bottom (11) of the dewatering box is formed as straight like portions (L1–Li) and edges (P1–Pi) between them, over which the web between the two wires moves, the edges (P1–Pi) between the straight portions (L1–Li) cause wire tension for producing pressure pulses for increasing dewatering efficiency.

2. The apparatus according to claim 1, wherein angles (α1–αi) between the straight portions (L1–Li) are of different magnitudes.

3. The apparatus according to claim 1, wherein angles (α1-αi) between the straight portions (L1–Li) are of equal magnitude.

4. The apparatus according to claim 1, wherein the straight portions (L1–Li) include one or more of the strips.

5. The apparatus according to claim 1, wherein the straight portions (L1–Li) are of equal width.

6. The apparatus according to claim 1, wherein the straight portions (L1–Li) are of different widths.

7. The apparatus according to claim 1, wherein the segmented line is formed on a solid bottom structure.

8. The apparatus according to claim 1, wherein the straight portions (L1–Li) are removable strips.

9. An apparatus for forming a paper or cardboard web from a fibrous suspension, said apparatus comprising:

a twin wire section consisting of a first wire loop formed by a first wire (v1), a second wire loop formed by a second wire (v2), and at least one headbox, from which headbox the fibrous suspension is fed into a space between the first and the second wire loops, said first wire loop being provided with a dewatering box (1) placed above the first wire and arranged to drain water from the fibrous suspension between the first and the second wire loops via a bottom (11) of the dewatering box and through the first wire, said apparatus further comprising:

two successive dewatering zones (L0, L1–Li) provided in an area of the dewatering box, wherein a direction of web movement in the first dewatering zone is away from the dewatering box, and runs of each first wire loop are substantially straight, while in the second dewatering zone a direction of web movement is towards the dewatering box and water drainage from the fibrous suspension is arranged to take place substantially in a direction towards the dewatering box, wherein the bottom of the dewatering box includes parts formed as strips in a second dewatering zone, and wherein to achieve effective water drainage in the second dewatering zone, the bottom (11) of the dewatering box is formed as straight like portions (L1–Li) and edges (P1–Pi) between them, over which the web between the two wires moves, wherein angles (α1–αi) between the straight portions (L1–Li) are of different magnitudes.

10. The apparatus according to claim 9, wherein the straight portions (L1–Li) are removable strips.

11. The apparatus according to claim 9, whereby wire tension at the edges (P1–Pi) between the straight portions (L1–Li) produces pressure pulses for increasing dewatering efficiency.

12. An apparatus for forming a paper or cardboard web from a fibrous suspension, said apparatus comprising:

a twin wire section consisting of a first wire loop formed by a first wire (v1), a second wire loop formed by a second wire (v2), and at least one headbox, from which headbox the fibrous suspension is fed into a space between the first and the second wire loops, said first wire loop being provided with a dewatering box (1) placed above the first wire and arranged to drain water from the fibrous suspension between the first and the second wire loops via a bottom (11) of the dewatering box and through the first wire, said apparatus further comprising:

two successive dewatering zones (L0, L1–Li) provided in an area of the dewatering box, wherein a direction of web movement in the first dewatering zone is away from the dewatering box, and runs of each first wire loop are substantially straight, while in the second dewatering zone a direction of web movement is towards the dewatering box and water drainage from the fibrous suspension is arranged to take place substantially in a direction towards the dewatering box, wherein the bottom of the dewatering box includes parts formed as strips in a second dewatering zone, and wherein to achieve effective water drainage in the second dewatering zone, the bottom (11) of the dewatering box is formed as straight like portions (L1–Li) and edges (P1–Pi) between them, over which the web between the two wires moves, wherein the straight portions (L1–Li) are of different widths.

13. The apparatus according to claim 12, wherein the straight portions (L1–Li) are removable strips.

14. The apparatus according to claim 12, whereby wire tension at the edges (P1–Pi) between the straight portions (L1–Li) produces pressure pulses for increasing dewatering efficiency.

* * * * *